US008269706B2

(12) United States Patent
Hwang

(10) Patent No.: US 8,269,706 B2
(45) Date of Patent: Sep. 18, 2012

(54) OPERATING UNIT OF LIQUID CRYSTAL DISPLAY PANEL AND METHOD FOR OPERATING THE SAME

(75) Inventor: Kwang Hee Hwang, Taegu-kwangyokshi (KR)

(73) Assignee: LG Display Co., Ltd., Seoul (KR)

( * ) Notice: Subject to any disclaimer, the term of this patent is extended or adjusted under 35 U.S.C. 154(b) by 927 days.

(21) Appl. No.: 11/072,321

(22) Filed: Mar. 7, 2005

(65) Prior Publication Data

US 2005/0200587 A1 Sep. 15, 2005

(30) Foreign Application Priority Data

Mar. 11, 2004 (KR) ..... 10-2004-0016521

(51) Int. Cl.
*G09G 3/36* (2006.01)

(52) U.S. Cl. ..... 345/94; 345/96; 345/208; 345/209

(58) Field of Classification Search ..... 345/94–100, 345/208–210

See application file for complete search history.

(56) References Cited

U.S. PATENT DOCUMENTS

| | | | | |
|---|---|---|---|---|
| 5,844,538 | A * | 12/1998 | Shiraki et al. | 345/98 |
| 6,008,801 | A * | 12/1999 | Jeong | 345/204 |
| 6,069,605 | A | 5/2000 | Ozawa et al. | |
| 6,127,995 | A * | 10/2000 | Furuhashi et al. | 345/96 |
| 6,600,469 | B1 * | 7/2003 | Nukiyama et al. | 345/87 |
| 2002/0003242 | A1 | 1/2002 | Uchiyama | |
| 2002/0084972 | A1 * | 7/2002 | Kim | 345/99 |
| 2004/0189575 | A1 | 9/2004 | Choi et al. | |

FOREIGN PATENT DOCUMENTS

| | | | |
|---|---|---|---|
| CN | 1138904 | A | 12/1996 |
| CN | 1534582 | A | 10/2004 |
| JP | 3-70279 | A | 3/1991 |
| JP | 2000-20027 | A | 1/2000 |
| JP | 2002-26231 | A | 1/2002 |
| JP | 2002-311913 | A | 10/2002 |
| JP | 2002-318566 | A | 10/2002 |
| JP | 2003-91267 | A | 3/2003 |
| JP | 2004-258485 | A | 9/2004 |
| TW | 518529 | | 1/2003 |
| TW | 521252 | | 2/2003 |
| TW | 525139 | | 3/2003 |

* cited by examiner

*Primary Examiner* — Alexander Eisen
*Assistant Examiner* — Cory Almeida
(74) *Attorney, Agent, or Firm* — Birch, Stewart, Kolasch & Birch, LLP

(57) ABSTRACT

An operating unit of an LCD panel and a method for operating the same are disclosed, to improve the picture quality by removing superior polarity. The operating unit includes a plurality of data driver ICs for supplying data to the data lines of the LCD panel, a plurality of gate driver ICs for sequentially operating the gate lines of the LCD panel, and a timing controller for supplying polarity control signals having opposite polarities respectively to first and second blocks of the data driver ICs formed by dividing the data driver ICs into multiple blocks.

15 Claims, 11 Drawing Sheets

FIG. 5A
Related Art

| | R | G | B | R | G | B | R | G | B | R | G | B | R | G | B | R | G | B | R | G | B | R | G | B | R | G | B | R | G | B | R | G | B | R | G | B | R | G | B | R | G | B | Superior polarity |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| Gate #1 Line | + | − | + | − | + | − | + | − | + | − | + | − | + | − | + | − | + | − | + | − | + | − | + | − | + | − | + | − | + | − | + | − | + | − | + | − | + | − | + | − | + | − | + |
| Gate #2 Line | − | + | − | + | − | + | − | + | − | + | − | + | − | + | − | + | − | + | − | + | − | + | − | + | − | + | − | + | − | + | − | + | − | + | − | + | − | + | − | + | − | + | − |
| Gate #3 Line | + | − | + | − | + | − | + | − | + | − | + | − | + | − | + | − | + | − | + | − | + | − | + | − | + | − | + | − | + | − | + | − | + | − | + | − | + | − | + | − | + | − | + |
| | − | + | − | + | − | + | − | + | − | + | − | + | − | + | − | + | − | + | − | + | − | + | − | + | − | + | − | + | − | + | − | + | − | + | − | + | − | + | − | + | − | + | − |
| | + | − | + | − | + | − | + | − | + | − | + | − | + | − | + | − | + | − | + | − | + | − | + | − | + | − | + | − | + | − | + | − | + | − | + | − | + | − | + | − | + | − | + |
| | − | + | − | + | − | + | − | + | − | + | − | + | − | + | − | + | − | + | − | + | − | + | − | + | − | + | − | + | − | + | − | + | − | + | − | + | − | + | − | + | − | + | − |
| | + | − | + | − | + | − | + | − | + | − | + | − | + | − | + | − | + | − | + | − | + | − | + | − | + | − | + | − | + | − | + | − | + | − | + | − | + | − | + | − | + | − | + |
| | − | + | − | + | − | + | − | + | − | + | − | + | − | + | − | + | − | + | − | + | − | + | − | + | − | + | − | + | − | + | − | + | − | + | − | + | − | + | − | + | − | + | − |

FIG. 5B
Related Art

| Gate #1 Line | R | G | B | R | G | B | R | G | B | R | G | B | R | G | B | R | G | B | R | G | B | R | G | B | R | G | B | R | G | B | R | G | B | R | G | B | R | G | B | R | G | B | Superior polarity |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| Gate #2 Line | − | + | − | + | − | + | − | + | − | + | − | + | − | + | − | + | − | + | − | + | − | + | − | + | − | + | − | + | − | + | − | + | − | + | − | + | − | + | − | + | − | + | − | + | + |
| Gate #3 Line | + | − | + | − | + | − | + | − | + | − | + | − | + | − | + | − | + | − | + | − | + | − | + | − | + | − | + | − | + | − | + | − | + | − | + | − | + | − | + | − | + | − | + | − | − |
| | − | + | − | + | − | + | − | + | − | + | − | + | − | + | − | + | − | + | − | + | − | + | − | + | − | + | − | + | − | + | − | + | − | + | − | + | − | + | − | + | − | + | − | + | + |
| | + | − | + | − | + | − | + | − | + | − | + | − | + | − | + | − | + | − | + | − | + | − | + | − | + | − | + | − | + | − | + | − | + | − | + | − | + | − | + | − | + | − | + | − | − |
| | − | + | − | + | − | + | − | + | − | + | − | + | − | + | − | + | − | + | − | + | − | + | − | + | − | + | − | + | − | + | − | + | − | + | − | + | − | + | − | + | − | + | − | + | + |
| | + | − | + | − | + | − | + | − | + | − | + | − | + | − | + | − | + | − | + | − | + | − | + | − | + | − | + | − | + | − | + | − | + | − | + | − | + | − | + | − | + | − | + | − | − |
| | − | + | − | + | − | + | − | + | − | + | − | + | − | + | − | + | − | + | − | + | − | + | − | + | − | + | − | + | − | + | − | + | − | + | − | + | − | + | − | + | − | + | − | + | + |
| | + | − | + | − | + | − | + | − | + | − | + | − | + | − | + | − | + | − | + | − | + | − | + | − | + | − | + | − | + | − | + | − | + | − | + | − | + | − | + | − | + | − | + | − | − |

FIG. 9A

| | R | G | B | R | G | B | R | G | B | R | G | B | R | G | B | R | G | B | R | G | B | R | G | B | R | G | B | R | G | B | R | G | B | R | G | B | R | G | B | R | G | B | Superior polarity |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| Gate #1 Line | + | − | + | − | + | − | + | − | + | − | + | − | + | − | + | − | + | − | − | + | − | + | − | + | − | + | − | + | − | + | − | + | − | + | − | + | − | + | − | + | − | + | − | 0 |
| Gate #2 Line | − | + | − | + | − | + | − | + | − | + | − | + | − | + | − | + | − | + | + | − | + | − | + | − | + | − | + | − | + | − | + | − | + | − | + | − | + | − | + | − | + | − | + | 0 |
| Gate #3 Line | + | − | + | − | + | − | + | − | + | − | + | − | + | − | + | − | + | − | − | + | − | + | − | + | − | + | − | + | − | + | − | + | − | + | − | + | − | + | − | + | − | + | − | 0 |
| | − | + | − | + | − | + | − | + | − | + | − | + | − | + | − | + | − | + | + | − | + | − | + | − | + | − | + | − | + | − | + | − | + | − | + | − | + | − | + | − | + | − | + | 0 |
| | + | − | + | − | + | − | + | − | + | − | + | − | + | − | + | − | + | − | − | + | − | + | − | + | − | + | − | + | − | + | − | + | − | + | − | + | − | + | − | + | − | + | − | 0 |
| | − | + | − | + | − | + | − | + | − | + | − | + | − | + | − | + | − | + | + | − | + | − | + | − | + | − | + | − | + | − | + | − | + | − | + | − | + | − | + | − | + | − | + | 0 |
| | + | − | + | − | + | − | + | − | + | − | + | − | + | − | + | − | + | − | − | + | − | + | − | + | − | + | − | + | − | + | − | + | − | + | − | + | − | + | − | + | − | + | − | 0 |
| | − | + | − | + | − | + | − | + | − | + | − | + | − | + | − | + | − | + | + | − | + | − | + | − | + | − | + | − | + | − | + | − | + | − | + | − | + | − | + | − | + | − | + | 0 |

FIG. 9B

| Gate #1 Line | R | G | B | R | G | B | R | G | B | R | G | B | R | G | B | R | G | B | R | G | B | R | G | B | R | G | B | R | G | B | R | G | B | R | G | B | R | G | B | R | G | B | Superior polarity |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| Gate #2 Line | − | + | − | + | − | + | − | + | − | + | − | + | − | + | − | + | − | + | + | − | + | − | + | − | + | − | + | − | + | − | + | − | + | − | + | − | + | − | + | − | + | − | + | − | 0 |
| Gate #3 Line | + | − | + | − | + | − | + | − | + | − | + | − | + | − | + | − | + | − | − | + | − | + | − | + | − | + | − | + | − | + | − | + | − | + | − | + | − | + | − | + | − | + | − | + | 0 |
| | − | + | − | + | − | + | − | + | − | + | − | + | − | + | − | + | − | + | + | − | + | − | + | − | + | − | + | − | + | − | + | − | + | − | + | − | + | − | + | − | + | − | + | − | 0 |
| | + | − | + | − | + | − | + | − | + | − | + | − | + | − | + | − | + | − | − | + | − | + | − | + | − | + | − | + | − | + | − | + | − | + | − | + | − | + | − | + | − | + | − | + | 0 |
| | − | + | − | + | − | + | − | + | − | + | − | + | − | + | − | + | − | + | + | − | + | − | + | − | + | − | + | − | + | − | + | − | + | − | + | − | + | − | + | − | + | − | + | − | 0 |
| | + | − | + | − | + | − | + | − | + | − | + | − | + | − | + | − | + | − | − | + | − | + | − | + | − | + | − | + | − | + | − | + | − | + | − | + | − | + | − | + | − | + | − | + | 0 |
| | − | + | − | + | − | + | − | + | − | + | − | + | − | + | − | + | − | + | + | − | + | − | + | − | + | − | + | − | + | − | + | − | + | − | + | − | + | − | + | − | + | − | + | − | 0 |
| | + | − | + | − | + | − | + | − | + | − | + | − | + | − | + | − | + | − | − | + | − | + | − | + | − | + | − | + | − | + | − | + | − | + | − | + | − | + | − | + | − | + | − | + | 0 |

OPERATING UNIT OF LIQUID CRYSTAL DISPLAY PANEL AND METHOD FOR OPERATING THE SAME

This invention claims the benefit of the Korean Patent Application No. 10-2004-0016521 filed on Mar. 11, 2004, which is hereby incorporated by reference.

BACKGROUND OF THE INVENTION

1. Field of the Invention

The present invention relates to a liquid crystal display (LCD) device, and more particularly, to an operating unit of an LCD panel and a method for operating the same, to prevent a greenish phenomenon, similar to a green color, generated on the entire screen.

2. Discussion of the Related Art

In general, an LCD device displays various images in a method of controlling light transmittance of liquid crystal cells according to a video signal. The LCD device has been generally applied to display devices for a monitor of a computer, a cellular phone, and office equipment, wherein the LCD device realizes an active matrix type of providing switching devices in respective liquid crystal cells. In this case, the switching device used for the LCD device of the active matrix type is generally formed of a thin film transistor (hereinafter, referred to as "TFT").

FIG. 1 is a block diagram illustrating an LCD device according to the related art. As shown in FIG. 1, the LCD device according to the related art includes an LCD panel 6, a digital video card 1, a data driver 3, a gate driver 5, and a timing controller 2. At this time, the LCD panel has a plurality of data lines DL and a plurality of gate lines GL, wherein each data line DL is formed in perpendicular to each gate line GL. Also, a thin film transistor TFT is formed at each crossing portion of the gate and data lines GL and DL in the LCD panel 6. Then, the digital video card 1 is provided to convert analog video data into digital video data. The data driver 3 supplies the video data to the data line DL of the LCD panel 6, and the gate driver 5 sequentially operates the gate lines GL of the LCD panel 6. Furthermore, the timing controller 2 is provided to control the data driver 3 and the gate driver 5.

Herein, the LCD panel 6 includes lower and upper glass substrates and a liquid crystal layer, wherein the liquid crystal layer is formed in a method of injecting liquid crystal between the lower and upper glass substrates. Also, the plurality of gate lines GL and the plurality of data lines DL are formed on the lower glass substrate. In this state, each of the gate lines GL is in perpendicular to each of the data lines DL. Then, the thin film transistor TFT is formed at each crossing portion of the gate line GL and the data line DL, wherein the thin film transistor TFT is formed to selectively supply an image inputted from the corresponding data line DL to a liquid crystal cell Clc. For this, each thin film transistor TFT has a gate terminal being in contact with the corresponding gate line GL, a source terminal being in contact with the corresponding data line DL, and a drain terminal being in contact with a pixel electrode of the corresponding liquid crystal cell Clc.

Then, the digital video card 1 converts an analog video signal to a digital video signal suitable for the LCD panel 6, and detects a synchronous signal included in the video signal. Also, the timing controller 2 supplies the digital video data of red (R), green (G), and blue (B) provided from the digital video card 1 to the data driver 3. Furthermore, the timing controller 2 generates data and gate control signals such as a dot clock Dclk and a gate start pulse Gsp by using horizontally/vertically synchronized signals H/V inputted from the digital video card 1, thereby controlling the timing of the data driver 3 and the gate driver 5. In this state, the data control signal such as the dot clock Dclk is supplied to the data driver 3, and the gate control signal such as the gate start pulse Gsp is supplied to the gate driver 5.

In more detail, the gate driver 5 is composed of a shift register and a level shifter. At this time, the shift register sequentially generates scan pulses in response to the gate start pulse Gsp inputted from the timing controller 2, and the level shifter shifts a voltage of the scan pulse to make a level suitable for operation of the liquid crystal cell Clc. In response to the scan pulse inputted from the gate driver 5, the video data of the data line DL is supplied to the pixel electrode of the liquid crystal cell Clc by the thin film transistor TFT.

In addition to the digital video data of red (R), green (G), and blue (B) from the timing controller 2, the dot clock Dclk is also inputted to the data driver 3. That is, the data driver 3 latches the digital video data of red (R), green (G), and blue (B) in synchronization with the dot clock Dclk, and then compensates the latched data according to a gamma voltage. After that, the data driver 3 converts the data compensated by the gamma voltage to analog data, and supplies the analog data to the data line DL by lines.

Hereinafter, an operating unit of an LCD panel and a method for operating the same according to the related art will be described with reference to the accompanying drawings. FIG. 2 is a block diagram illustrating a gate driver and a data driver in an LCD panel according to the related art. FIG. 3 is a block diagram illustrating the data driver of FIG. 2. FIG. 4 is a detailed block diagram illustrating one of a plurality of data drivers ICs for the data driver of FIG. 3.

As shown in FIG. 2, the LCD device according to the related art includes an LCD panel 10, a data driver 20, a gate driver 30, and a timing controller 40. At this time, the LCD panel 10 is formed in a matrix type having a plurality of liquid crystal cells Clc. Also, the LCD panel 10 includes a plurality of gate lines GL and a plurality of data lines DL, wherein each of the gate lines GL is formed in perpendicular to each of the data lines DL. In addition, a plurality of thin film transistors TFT are formed at respective crossing portions of the gate and data lines GL and DL. Then, the data driver 20 supplies data video signals to the data lines DL of the LCD panel 10, and the gate driver 30 sequentially operates the gate lines GL of the LCD panel 10. Also, the timing controller 40 is provided to apply a data control signal and a polarity control signal to the data driver 20, and to apply a gate control signal to the gate driver 30.

As shown in FIG. 3, the data driver 20 includes a plurality of data driver ICs 20*a* to 20*f*, which are operated with the data control signal and the polarity control signal inputted from the timing controller 40.

Specifically, as shown in FIG. 4, the data driver IC 20*a* is composed of a shift register array 21, a latch array 22, a digital-analog conversion (hereinafter, referred to as 'DAC') array 23, and an output buffer array 24. At this time, the shift register array 21 supplies sequential sampling signals. In response to the sampling signals of the shift register array 21, the latch array 22 sequentially latches pixel data VD, and simultaneously outputs the latched pixel data VD. Also, the DAC array 23 converts the pixel data VD outputted from the latch array 22 to pixel voltage signals. Then, the output buffer array 24 compensates and outputs the pixel voltage signals outputted from the DAC array 23. The data driver ICs drive the data lines of 'k' channel.

In this case, shift registers of the shift register array 21 sequentially shift source start pulses SSP from the timing controller 40 according to a source sampling clock signal SSC, and then outputs the shifted source start pulses SSP as the sampling signals.

Subsequently, the latch array 22 responds to the sampling signals outputted from the shift register array 21, so that the pixel data VD is sequentially sampled and latched by predetermined sizes. For this, the latch array 22 is composed of 'k' latches for latching the pixel data VD numbered in 'k', and each latch has a size corresponding to a bit number of the pixel data VD (3 bit or 6 bit). After that, the latch array 22 responds to a source output enable signal SOE outputted from the timing controller 40, thereby simultaneously outputting the latched pixel data VD numbered in 'k'.

The DAC array 23 converts the pixel data VD outputted from the latch array 22 into the positive (+) polarity pixel voltage signal and the negative (−) polarity pixel voltage signal, and simultaneously outputs the positive (+) polarity pixel voltage signal and the negative (−) polarity pixel voltage signal. For this, the DAC array 23 includes a P (positive) decoder array 25, an N (negative) decoder array 26, and an MUX (multiplexer) array 27. At this time, the P decoder array 25 and the N decoder array 26 are connected with the latch array 22, and the MUX array 27 is provided to select an output signal from the P decoder array 25 and the N decoder array 26.

At this time, the P decoder array 25 includes P decoders of 'k' channel, wherein the P decoders convert the pixel data outputted from the latch array 22 into the positive (+) polarity pixel voltage signal by using positive polarity gamma voltages outputted from a gamma voltage unit (not shown), and then output the positive (+) polarity pixel voltage signal. Also, the N decoder array 26 includes N decoders of 'k' channel, wherein the N decoders convert the pixel data outputted from the latch array 22 into the negative (−) polarity pixel voltage signal by using negative (−) polarity gamma voltages outputted from the gamma voltage unit, and then output the negative (−) polarity pixel voltage signal. Then, multiplexers of 'k' channel provided to the MUX array 27 respond to the polarity control signal POL outputted from the timing controller 40, so that it is possible to selectively output the positive (+) polarity pixel voltage signal from the P decoder array 25 or the negative (−) polarity pixel voltage signal from the N decoder array 26.

For example, the polarity of the polarity control signal POL is oppositely changed by each horizontal period H. In response to the polarity of the polarity control signal POL, the MUX array 27 selectively outputs the pixel voltage signals such that the polarities of the pixel voltage signals are differently supplied in the adjacent multiplexers by each horizontal period H, for operation of a dot inversion method. Also, the output buffer array 24 includes output buffers of 'k' channel, in which the output buffers are provided with voltage followers respectively connected with the data lines of 'k' channel in series. The output buffers buffer the pixel voltage signals outputted from the DAC array 23, and provide the buffered pixel voltage signals to the data lines.

The LCD panel of the LCD device according to the related art is operated in the dot inversion method explained below with reference to FIG. 5A and FIG. 5B.

As shown in FIG. 5A and FIG. 5B, when operating the related art LCD panel in the dot inversion method, a polarity of a data signal is differently supplied to adjacent liquid crystal cells by a column line and a row line on the LCD panel. At the same time, the data signal is supplied such that the polarity of the data signal is oppositely provided to all the liquid crystal cells of the LCD panel by each frame.

That is, in case of displaying a video signal of one frame on the LCD panel in the dot inversion method, as the liquid crystal cells sequentially progress from the left in the upper side to the right in the lower side, the data signals of the positive (+) polarity and the negative (−) polarity are alternately provided to the liquid crystal cells of the LCD panel, as shown in FIG. 5A.

Then, as shown in FIG. 5B, when displaying a video signal of the next frame, the polarities of the data signals provided to the liquid crystal cells are opposite to the polarities of the data signals supplied on the prior frame.

In the dot inversion method, the polarity of the data signal is differently applied to the liquid crystal cells adjacent in the horizontal and vertical directions of the LCD panel, thereby obtaining a greater picture image than that of a frame inversion method or a line inversion method. For this reason, the dot inversion method for operating the LCD panel is generally used.

However, the operating unit of the LCD panel and the method for operating the same according to the related art have the following disadvantages.

That is, there is superior polarity in a common gate line due to the positive (+) polarity or the negative (−) polarity when charging the data by each frame, so that it may generate distortion in the data charging characteristics. As a result, the picture quality deteriorates due to the greenish phenomenon, similar to a green color, on the entire screen of the LCD panel.

SUMMARY OF THE INVENTION

Accordingly, the present invention is directed to an operating unit of an LCD panel and a method for operating the same that substantially obviate one or more problems due to limitations and disadvantages of the related art.

An object of the present invention is to provide an operating unit of an LCD panel and a method for operating the same, in which a plurality of data driver ICs are divided into the left part and the right part, and then polarity control signals of the opposite polarities are separately and respectively supplied to the left part and the right part, so as to remove the superior polarity, thereby improving the picture quality.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is an operating device for an LCD panel including liquid crystal cells in a matrix type configuration, the liquid crystal cells defined by a plurality of gate and data liens, the operating device comprising: a plurality of data drive ICs for supplying data to the data lines of the LCD panel, a plurality of gate driver ICs for sequentially operating the gate lines of the LCD panel, and a timing controller for supplying polarity control signals having opposite polarities respectively to first and second blocks of the data driver ICs formed by dividing the data driver ICs into multiple blocks.

In another aspect of the present invention, there is a method for operating a plurality of data driver ICs for an LCD panel, the method comprising: receiving a data control signal and first and second polarity control signals from a timing controller, the first and second polarity control signals having opposite phases, wherein the plurality of data driver ICs are divided into a first block and a second block, and supplying the first and second polarity control signals of opposite phases respectively to the first block of the data driver ICs and the second block of the data driver ICs.

In another aspect of the present invention, there is the device for operating a display panel having a plurality of data lines and gate lines, the device comprising: a data driver including a plurality of data driver units for supplying data to the data lines, the data driver units divided into a first block of data driver units and a second block of data driver units, and a controller for supplying first and second polarity control signals respectively to the first and second blocks of data driver units, the first and second polarity control signals having opposite phases to each other.

In another aspect of the present invention, there is a method for operating a display panel having a plurality of data lines and gate lines, the method comprising: dividing a plurality of data driver units of a data driver into a first block of data driver units and a second block of data driver units, the data driver supplying data to the data lines, and supplying first and second polarity control signals respectively to the first and second blocks of a driver units, the first and second polarity control signals having opposite phases to each other.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIGS. 5A and 5B illustrate a dot inversion method of an LCD panel according to the related art;

FIGS. 9A and 9B illustrate a dot inversion method of an LCD panel according to the present invention.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Hereinafter, an operating unit of an LCD panel and a method for operating the same according to the present invention will be described with reference to the accompanying drawings.

Figure 1:
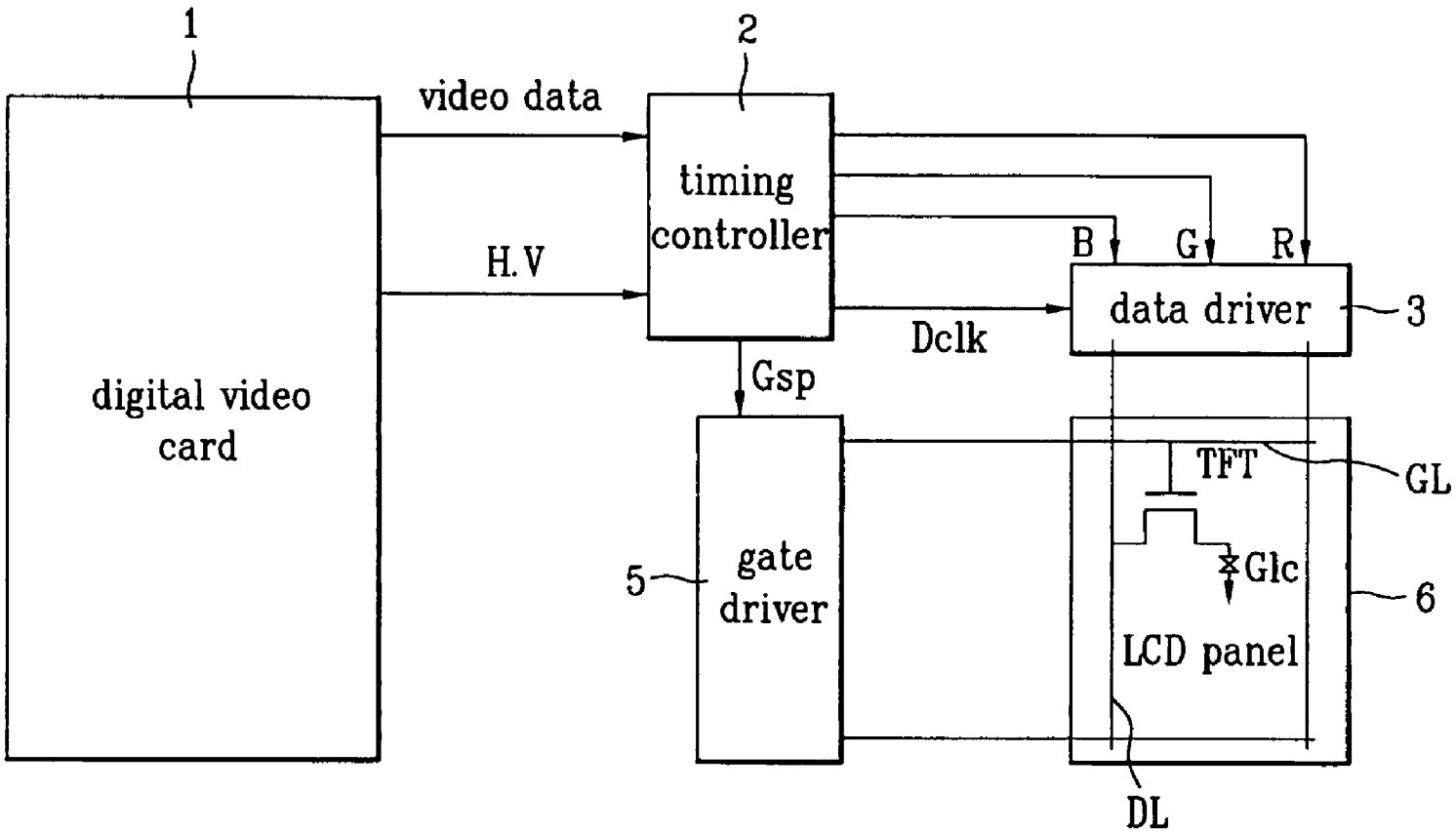
FIG. 1 Related Art
FIG. 1 is a block diagram illustrating an LCD device according to the related art.
Figure 2:
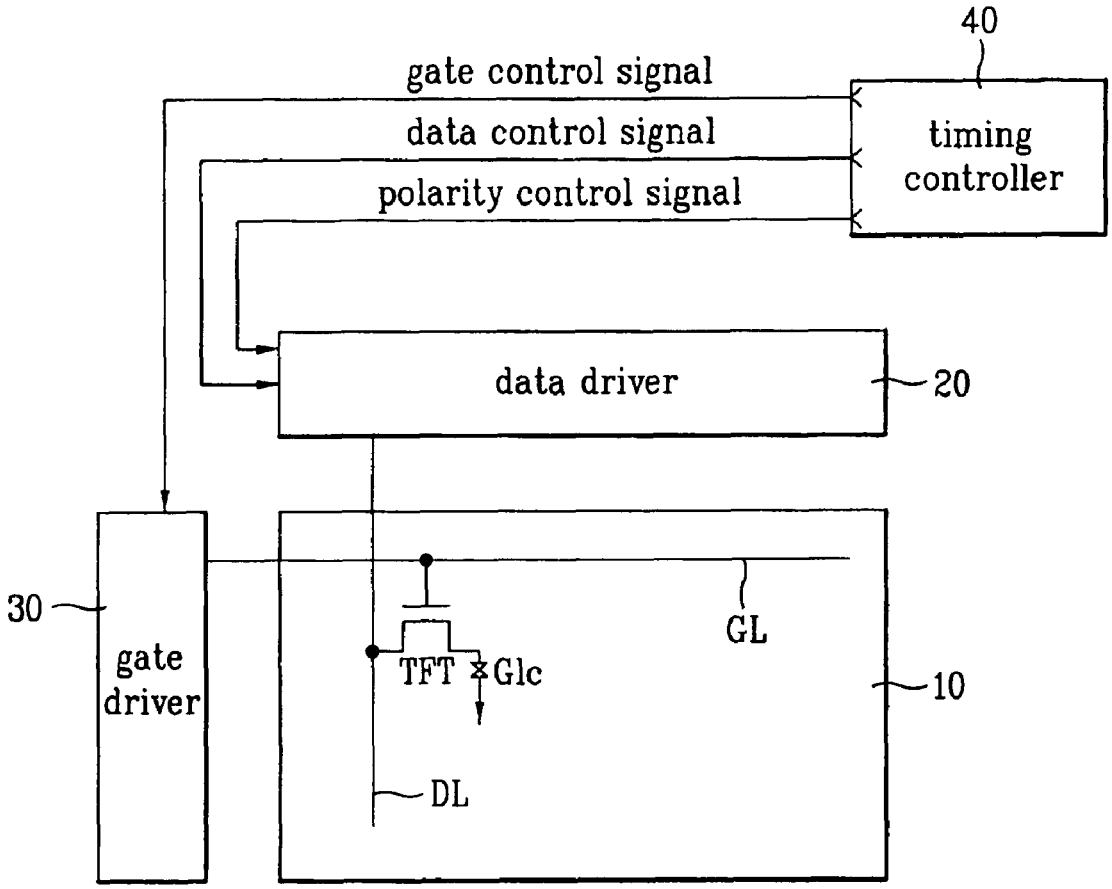
FIG. 2 Related Art
FIG. 2 is a schematic view illustrating an operating unit of an LCD panel according to the related art.
Figure 3:
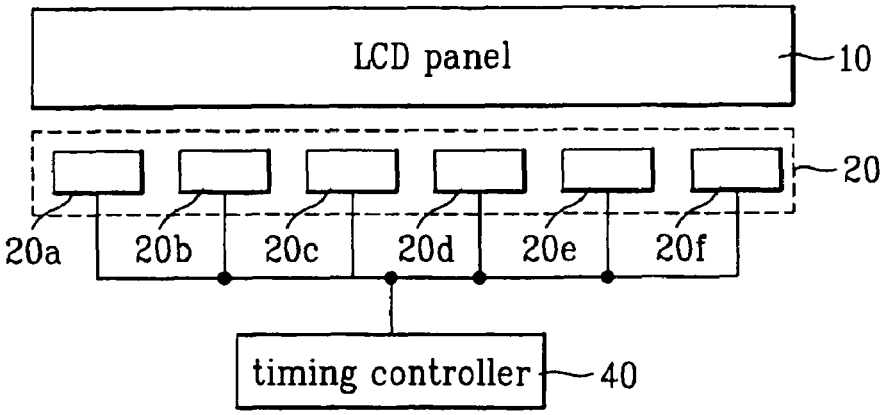
FIG. 3 Related Art
FIG. 3 is a block diagram illustrating a data driver of FIG. 2.
Figure 4:
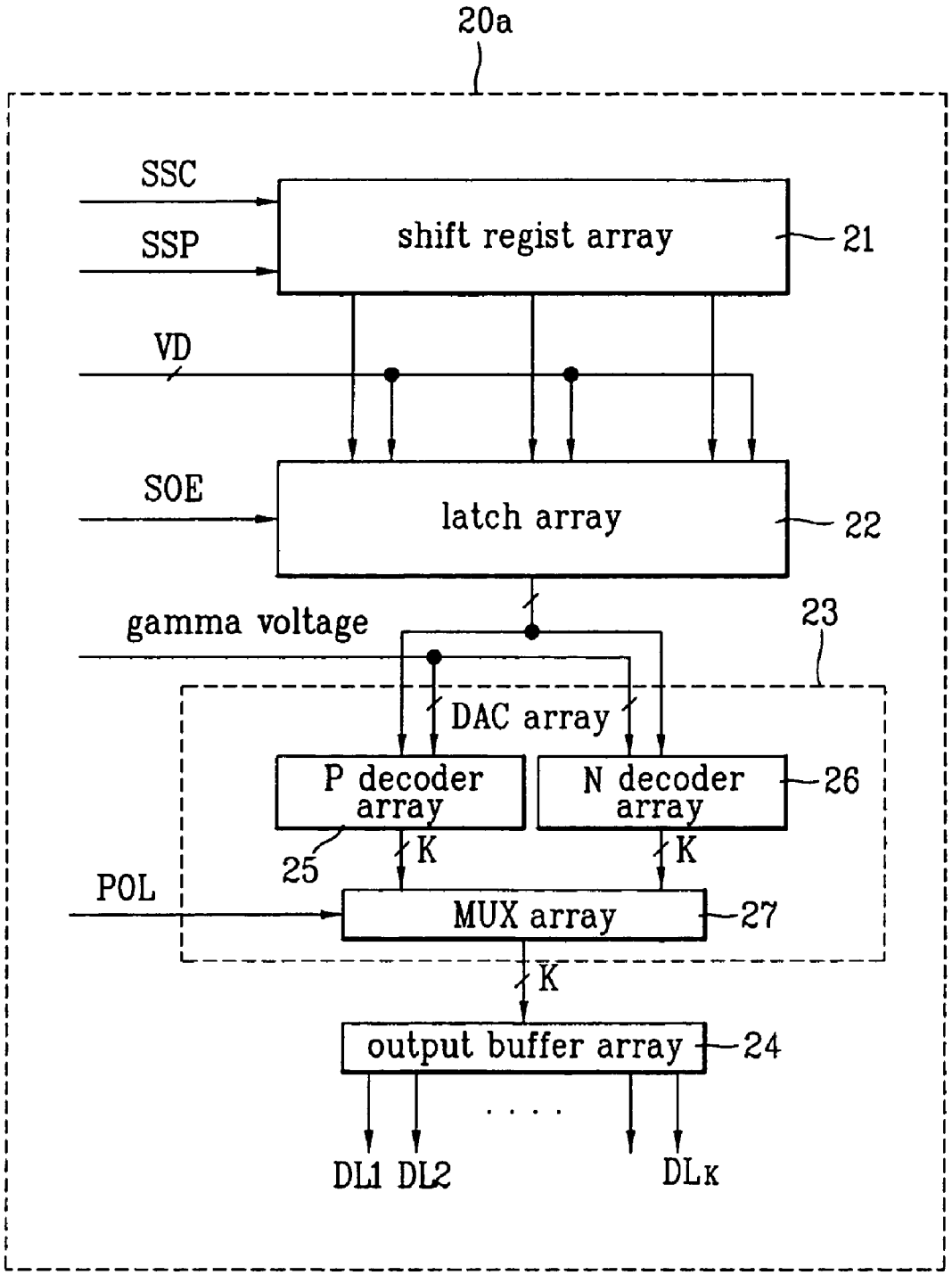
FIG. 4 Related Art
FIG. 4 is a detailed block diagram illustrating one of a plurality of data driver ICs for the data driver of FIG. 3.
Figure 6:
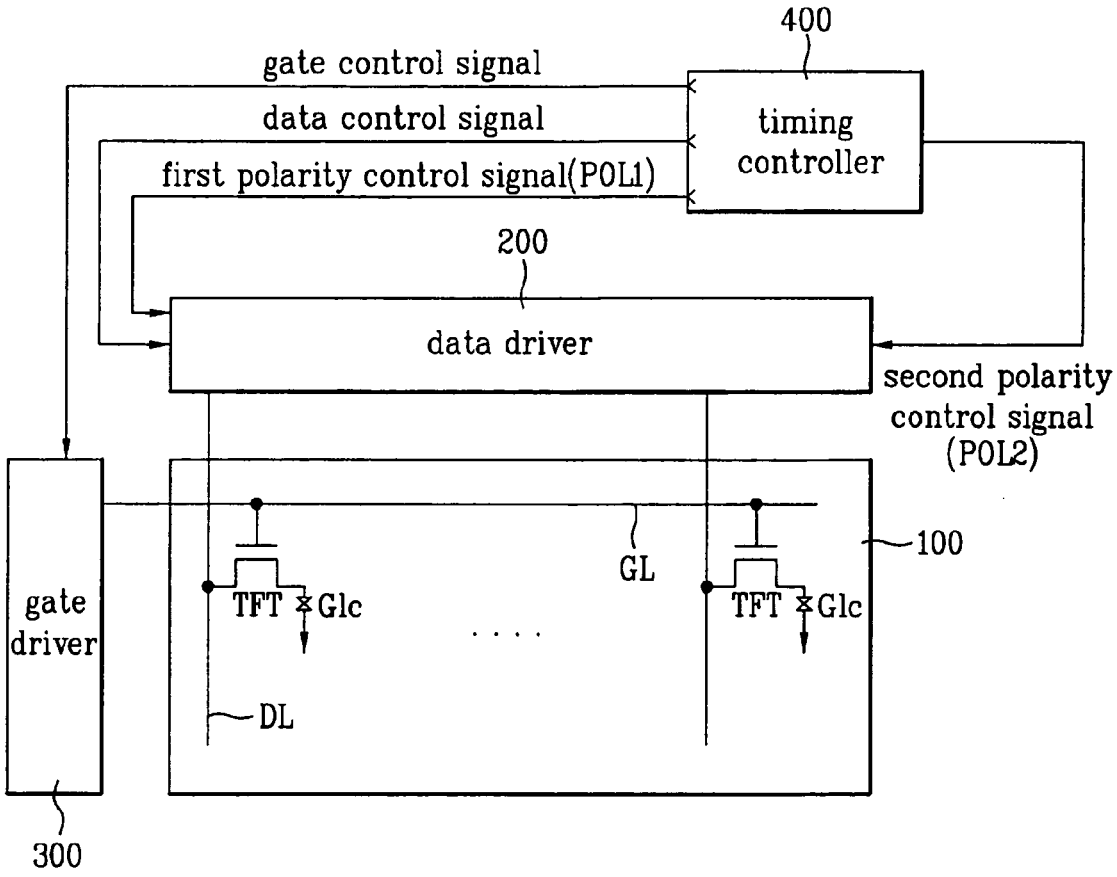
FIG. 6 is a schematic view illustrating an operating unit of an LCD panel according to the present invention.

FIG. 6 is a schematic view illustrating an operating unit of an LCD panel according to the present invention. As shown in FIG. 6, there are an LCD panel 100, a data driver 200, a gate driver 300, and a timing controller 400, all operatively coupled. At this time, the LCD panel 100 includes a plurality of liquid crystal cells Clc arranged in a matrix type configuration. Also, the LCD panel 100 has a plurality of gate lines GL and a plurality of data lines DL, wherein each of the gate lines GL is formed in perpendicular to each of the data lines DL. Then, a plurality of thin film transistors TFT are formed at respective crossing portions of the plurality of gate and data lines GL and DL. After that, the data driver 200 supplies data to the data lines DL of the LCD panel 100, and the gate driver 300 supplies scan signals to the gate lines GL of the LCD panel 100.

The timing controller 400 outputs a data control signal, a first polarity control signal, a second polarity control signal, and a gate control signal, thereby controlling the data driver 200 and the gate driver 300.

The LCD panel 100 is composed of lower and upper glass substrates, wherein liquid crystal is injected or provided between the lower and upper glass substrates. The plurality of gate and data lines GL and DL are formed on the lower glass substrate of the LCD panel 100, wherein each gate line GL is disposed perpendicular to each data line DL.

Also, the thin film transistor TFT is formed at each crossing portion of the gate line GL and the data line DL. At this time, each thin film transistor TFT selectively supplies an image inputted from the corresponding data line DL to the corresponding liquid crystal cell Clc. For this, each thin film transistor TFT has a gate terminal being in contact with the corresponding gate line GL, a source terminal being in contact with the corresponding data line DL, and a drain terminal being in contact with a pixel electrode of the corresponding liquid crystal cell Clc.

The timing controller 400 generates the gate control signal GDC for controlling the gate driver 300, the data control signal DDC for controlling the data driver 200, and the first and second polarity control signals POL1 and POL2 by using horizontally/vertically synchronized signals and a clock signal inputted from a graphic controller of a system through an interface circuit (not shown).

At this time, the gate control signal GDC includes a gate start pulse GSP, a gate shift clock GSC, and a gate output enable GOE. Also, the data control signal DDC includes a source start pulse SSP, a source shift clock SSC, and a source output enable SOE.

In the meantime, an inverter may be additionally provided inside or the outside of the timing controller 400 according to the present invention. Through the inverter, the first polarity control signal POL1 and the second polarity control signal POL2 having the opposite polarity are outputted to the data driver 200.

Figure 7:
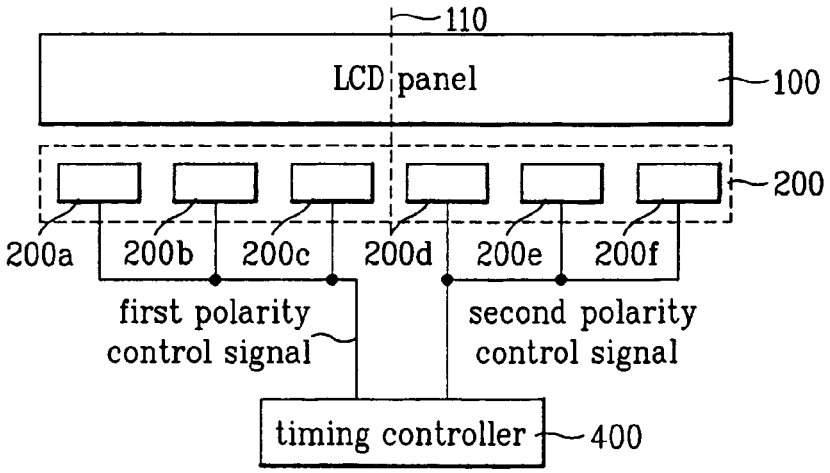
FIG. 7 is a block diagram illustrating a data driver of FIG. 6 according to an embodiment of the present invention.

That is, as shown in FIG. 7, the data driver 200 is composed of a plurality of data driver ICs 200*a* to 200*f*. In the present example of the operating unit of the LCD panel according to the present invention, there are six data driver ICs 200*a* to 200*f*. However, the operating unit may have more or less data driver ICs than six, according to the size of the LCD panel 100.

In this state, the plurality of data driver ICs 200*a* to 200*f* are divided into the left part and the right part along a center line 110, wherein the first polarity control signal POL1 is applied to the data driver ICs 200*a*, 200*b*, and 200*c* in the left part, and the second polarity control signal POL2 is applied to the data driver ICs 200*d*, 200*e*, and 200*f* in the right part. At this time, the polarity of the first polarity control signal POLl is opposite to the polarity of the second polarity control signal POL2.

Figure 8A:
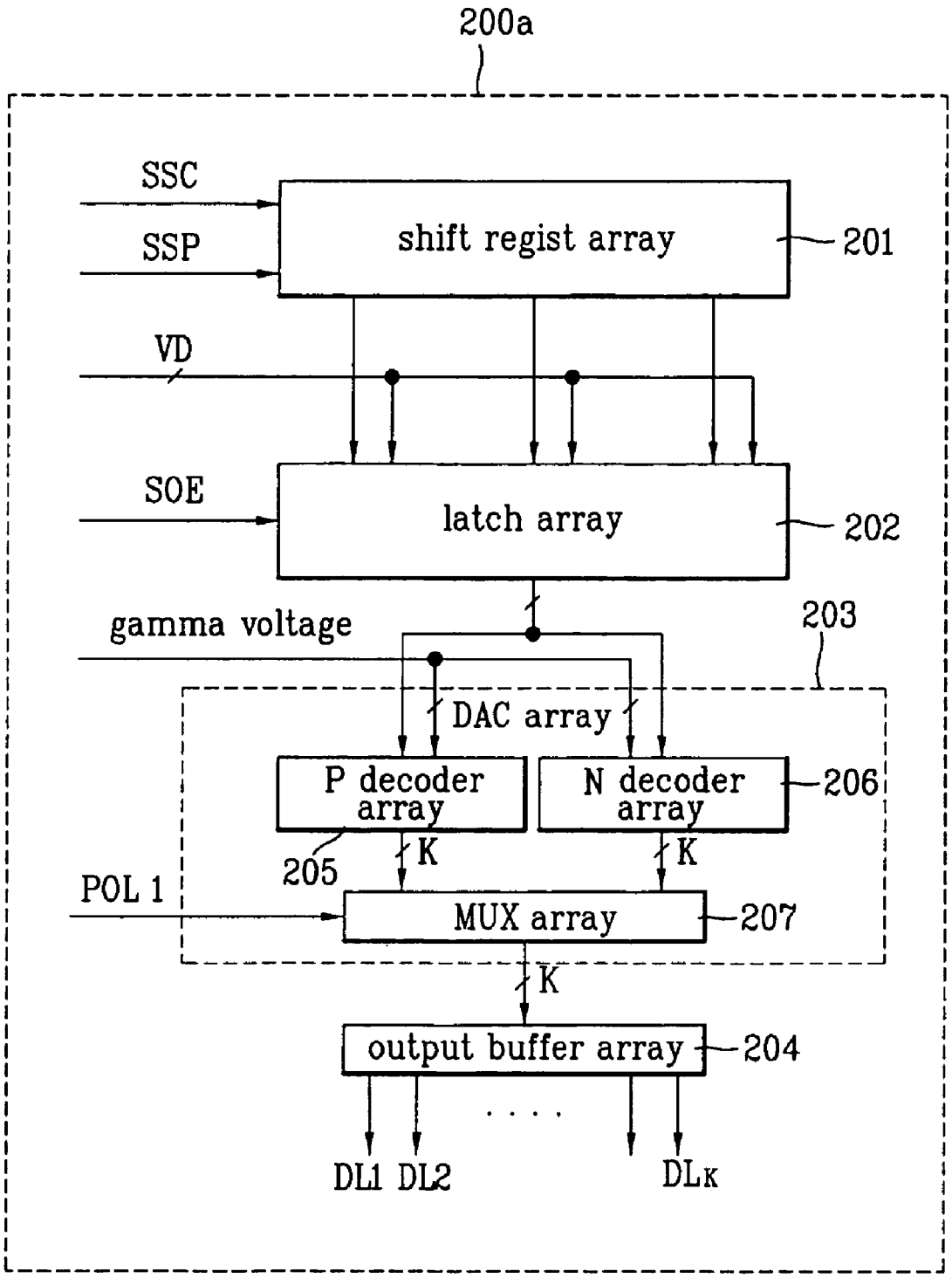
FIGS. 8A and 8B are detailed block diagrams illustrating the left-side and right-side data driver ICs for the data driver of FIG. 7 according to an embodiment of the present invention.
Figure 8B:
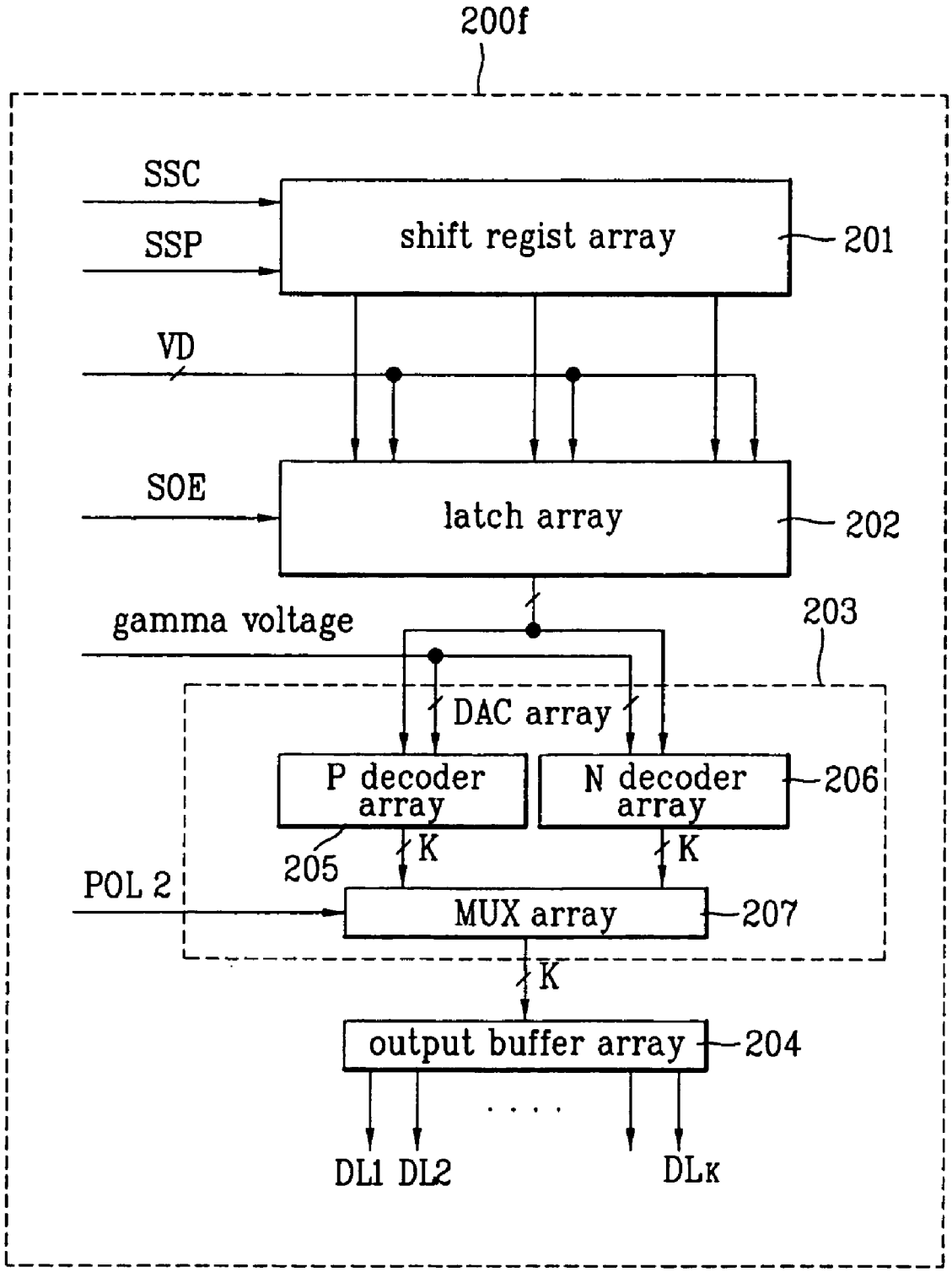

FIGS. 8A and 8B are detailed block diagrams illustrating the data driver ICs of the left and right parts in the data driver of FIG. 7. Specifically, the data driver IC 200*a* positioned in the left part of the data driver has the same structure as the data driver IC 200*f* positioned in the right part of the data driver. In fact, the data driver ICs 200*a*-200*f* have the same structure.

That is, as shown in FIG. 8A and FIG. 8B, each data driver IC includes a shift register array 201, a latch array 202, a digital-analog conversion DAC array 203, and an output buffer array 204, all operatively coupled. At this time, the shift register array 201 supplies sequential sampling signals. Also, the latch array 202 sequentially latches and simultaneously outputs pixel data VD in response to the sampling signals outputted from the shift register array 201. Then, the DAC array 203 converts the pixel data VD outputted from the latch array 202 to pixel voltage signals, and the output buffer array 204 buffers and outputs the pixel voltage signals outputted from the DAC array 203.

Each of the data driver ICs 200*a*-200*f* operates the data lines (DL1 to DLk) of 'k' channel.

In this case, shift registers of the shift register array 201 sequentially shift the source start pulses SSP outputted from the timing controller 400 according to the source sampling clock SSC signal, and then outputs the shifted source start pulses SSP as the sampling signal.

Subsequently, the latch array 202 responds to the sampling signal outputted from the shift register array 201, so that the pixel data VD outputted from the timing controller 400 is sequentially sampled and latched by predetermined sizes. For this, the latch array 202 is composed of 'k' latches for latching the pixel data VD numbered in 'k', and each latch has a size corresponding to a bit number of the pixel data VD (3 bit or 6 bit). After that, the latch array 202 responds to the source output enable SOE signal outputted from the timing controller 400, thereby simultaneously outputting the latched pixel data VD numbered in 'k'.

The DAC array 203 converts the pixel data VD outputted from the latch array 202 into the positive (+) polarity pixel voltage signal and the negative (−) polarity pixel voltage signal. For this, the DAC array 203 includes a P (positive) decoder array 205, an N (negative) decoder array 206, and an MUX (multiplexer) array 207. At this time, the P decoder array 205 and the N decoder array 206 are connected with the latch array 202, and the MUX array 207 is provided to select an output signal of the P decoder array 205 and the N decoder array 206.

The P decoder array 205 includes P decoders of 'k' channel, wherein the P decoders convert the pixel data outputted from the latch array 202 into the positive (+) polarity pixel voltage signal by using positive polarity gamma voltages outputted from a gamma voltage unit, and then output the positive (+) polarity pixel voltage signal.

The N decoder array 206 includes N decoders of 'k' channel, wherein the N decoders convert the pixel data outputted from the latch array 202 into the negative (−) polarity pixel voltage signal by using negative polarity gamma voltages outputted from the gamma voltage unit, and then output the negative (−) polarity pixel voltage signal.

For example, the P decoder array 205 converts the pixel data VD inputted from the latch array 202 by each horizontal period 1H into the positive (+) polarity pixel voltage signal for a common voltage Vcom. Subsequently, the N decoder array 206 converts the pixel data VD inputted from the latch array 202 by each horizontal period 1H into the negative (−) polarity pixel voltage signal for the common voltage Vcom.

Then, multiplexers of 'k' channel provided in the MUX array 207 respond to the first polarity control signal POL1 and the second polarity control signal POL2 outputted from the timing controller 400, and thereby selectively output the positive (+) polarity pixel voltage signal outputted from the P decoder array 205 or the negative (−) polarity pixel voltage signal outputted from the N decoder array 206 according to the signals POL1 and POL2.

For example, the first polarity control signal POL1 and the second polarity control signal POL2 are outputted such that the polarities of the first polarity control signal POL1 and the second polarity control signal POL2 change by each horizontal period 1H. In this state, the polarity of the first polarity control signal POL1 is opposite to the polarity of the second polarity control signal POL2 in each period. In response to the first polarity control signal POL1 and the second polarity control signal POL2, the adjacent multiplexers of the MUX array 207 selectively output the pixel voltage signals having the different polarities by the horizontal period H.

That is, in case of the operating unit of the LCD panel according to the present invention, the plurality of data driver ICs 200*a* to 200*f* are divided into the left part and the right part by the central line 110, wherein the first polarity control signal POL1 is applied to the data driver ICs 200*a*, 200*b*, and 200*c* in the left part, and the second polarity control signal POL2 is applied to the data driver ICs 200*d*, 200*e*, and 200*f* in the right part. Thus, the first polarity control signal POL1 and the second polarity control signal POL2 having the opposite polarities are respectively applied to the left part and the right part of the data driver ICs, whereby the data driver ICs are operated in a dot inversion method.

Also, the output buffer array 204 includes output buffers of 'k' channel, in which the output buffers are provided with voltage followers respectively connected with the data lines DL1 to DLk of 'k' channel in series. The output buffers buffer the pixel voltage signals outputted from the DAC array 203, and provide the buffered pixel voltage signals to the data lines DL1 to DLk.

Accordingly, the LCD panel of FIGS. 6-8B according to the present invention is operated in the dot inversion method explained below in more detail with reference to FIG. 9A and FIG. 9B. As shown in FIG. 9A and FIG. 9B, when operating the LCD panel in the dot inversion method, the polarity of a data signal is differently supplied to adjacent liquid crystal cells by a column line and a row line on the LCD panel. At the same time, the data signal is supplied such that the polarity of the data signal is oppositely provided to all the liquid crystal cells of the LCD panel by each frame.

Herein, the liquid crystal cells are divided into the left part and the right part. In this state, the polarity of the data signal supplied to the left part of the liquid crystal cells is opposite to the polarity of the data signal supplied to the right part of the liquid crystal cells.

That is, in case of displaying a video signal of one frame on the LCD panel in the dot inversion method according to the present invention, as the liquid crystal cells progress from the left in the upper side to the right in the lower side, the data signals of the positive (+) polarity and the negative (−) polarity are alternately provided to the liquid crystal cells of the LCD panel, as shown in FIG. 9A.

Then, when displaying a video signal of the next frame as shown in FIG. 9B, the polarities of the data signals provided to the liquid crystal cells are opposite to the polarities of the data signals supplied on the prior frame.

In the dot inversion method according to the present invention, the polarity of the data signal is differently applied to the liquid crystal cells adjacent in the horizontal and vertical directions of the LCD panel, thereby obtaining a greater picture image than that of a frame inversion method or a line inversion method.

Figure 10:
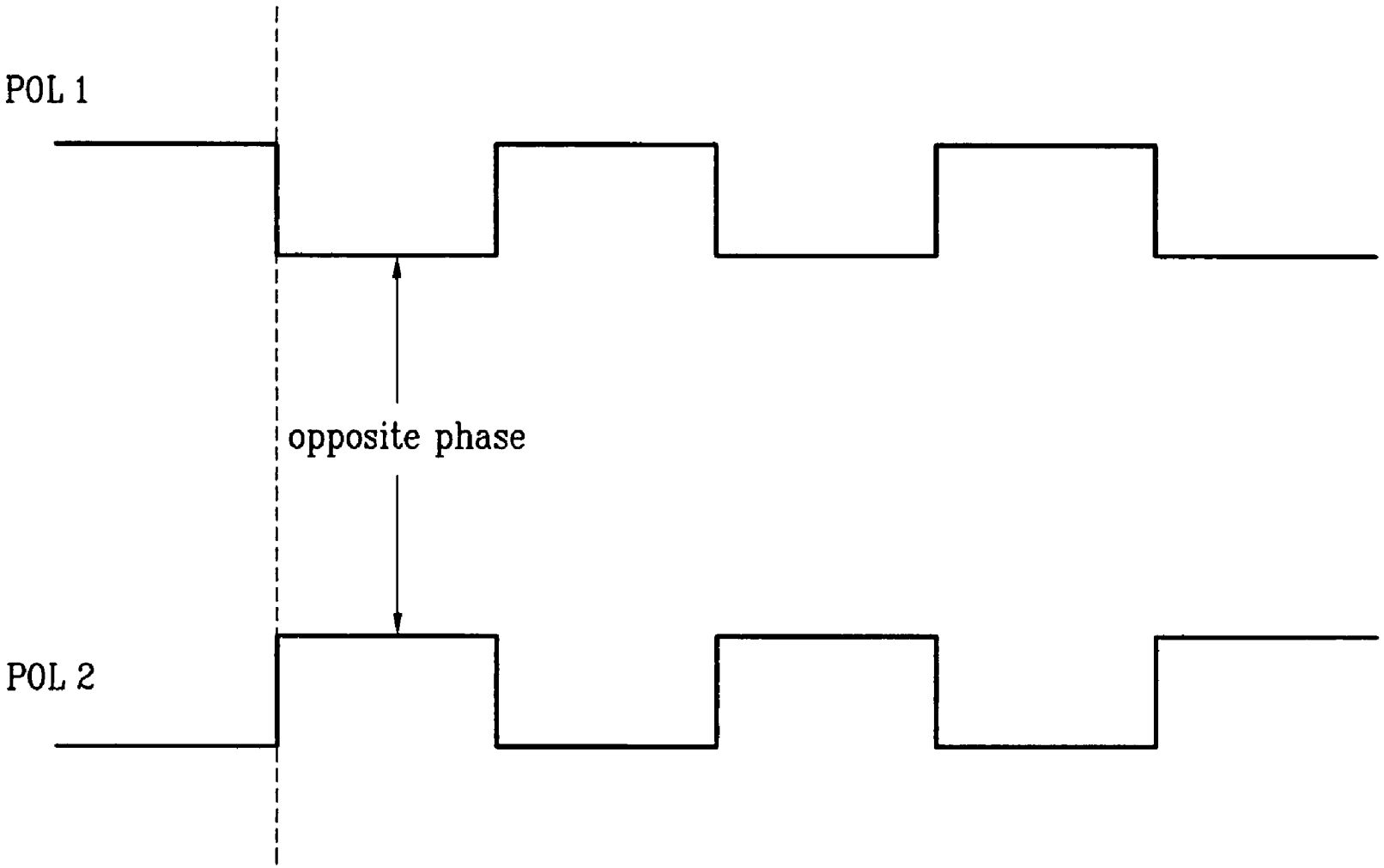
FIG. 10 is a timing view illustrating an example of a first polarity control signal and a second polarity control signal applied to a data driver in an operating unit of an LCD panel according to the present invention.

FIG. 10 is a timing view illustrating an example of the first polarity control signal and the second polarity control signal applied to the data driver 200 of the operating unit in the LCD panel according to the present invention.

As shown in FIG. 10, the first polarity control signal POL1 has an opposite phase to that of the second polarity control signal POL2. Also, the first polarity control signal POL and the second polarity control signal POL2 having the opposite phases are separately applied to the left and right parts of the data driver, divided into the two parts by the central line.

As described above, the operating unit of the LCD panel and the method for operating the same according to the present invention have at least the following advantages.

In the LCD panel according to the present invention, the data driver includes a plurality of data driver ICs corresponding to the LCD panel. In this state, the plurality of data driver ICs are divided into the left part and the right part by the central line. Then, the first polarity control signal and the second polarity control signal having the opposite phases to each other are separately applied to the data driver ICs of the left part and the right part. Accordingly, the LCD panel according to the present invention is driven in the dot inversion method, thereby preventing the greenish phenomenon and the flickers.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An operating device for an LCD panel including liquid crystal cells in a matrix type configuration, the liquid crystal cells defined by a plurality of gate and data lines, the operating device comprising:

a plurality of data driver ICs for supplying data to the data lines of the LCD panel, the plurality of data driver ICs being divided into first and second blocks of the data driver ICs by a central line of all the plurality of data lines, wherein each of the first and second blocks has at least two data driver ICs;

a plurality of gate driver ICs for sequentially operating the gate lines of the LCD panel; and a timing controller for supplying a first polarity control signal to only the first block of the data driver ICs and a second polarity control signal to only the second block of the data driver ICs, the first and second polarity control signals having opposite phases to each other, wherein the first and second blocks of the data driver ICs are operated according to a dot inversion method, wherein each data driver IC includes a shift register array supplying sequential sampling signals, a latch array sequentially latching and simultaneously outputting pixel data in response to the sampling signals, a DAC array converting the pixel data into a positive (+) polarity pixel voltage signal and a negative (−) polarity pixel voltage signal according to the first or second polarity control signal, and an output buffer array buffering and outputting the pixel voltage signals to the data lines, and wherein a polarity of the first polarity control signal and a polarity of the second polarity control signal are changed by each horizontal period and have opposite polarities in the each horizontal period.

2. The operating device of claim 1, wherein an inverter is provided inside or outside of the timing controller, to separately apply the polarity control signals having the opposite polarities to the first block of the data driver ICs and the second block of the data driver ICs.

3. A method for operating a plurality of data driver ICs for an LCD panel, the method comprising:

receiving a data control signal and first and second polarity control signals from a timing controller, the first and second polarity control signals having opposite phases, wherein the plurality of data driver ICs are divided into a first block and a second block by a center line of all data lines, wherein each of the first and second blocks has at least two data driver ICs; and supplying the first and second polarity control signals of opposite phases respectively to the first block of the data driver ICs and the second block of the data driver ICs, wherein the first and second blocks of the data driver ICs are driven according to a dot inversion method, wherein each data driver IC includes a shift register array supplying sequential sampling signals, a latch array sequentially latching and simultaneously outputting pixel data in response to the sampling signals, a DAC array converting the pixel data into a positive (+) polarity pixel voltage signal and a negative (−) polarity pixel voltage signal according to the first or second polarity control signal, and an output buffer array buffering and outputting the pixel voltage signals to the data lines, and wherein a polarity of the first polarity control signal and a polarity of the second polarity control signal are changed by each horizontal period and have opposite polarities in the each horizontal period.

4. The operating method of claim 3, wherein in the supplying step, an inverter is provided inside or outside of the timing controller, for separately supplying the first and second polarity control signals of the opposite phases to the first block of the data driver ICs and the second block of the data driver ICs.

5. A device for operating a display panel having a plurality of data lines and gate lines, the device comprising:

a data driver including a plurality of data driver units for supplying data to the data lines, the data driver units divided into a first block of data driver units and a second block of data driver units by a center line of all the plurality of data lines, wherein each of the first and second blocks has at least two data driver units; and a controller for supplying first and second polarity control signals respectively to the first and second blocks of data driver units, the first and second polarity control signals having opposite phases to each other, wherein the first and second blocks of data driver units are driven according to a dot inversion method, wherein each data driver IC includes a shift register array supplying sequential sampling signals, a latch array sequentially latching and simultaneously outputting pixel data in response to the sampling signals, a DAC array converting the pixel data into a positive (+) polarity pixel voltage signal and a negative (−) polarity pixel voltage signal according to the first or second polarity control signal, and an output buffer array buffering and outputting the pixel voltage signals to the data lines, and wherein a polarity of the first polarity control signal and a polarity of the second polarity control signal are changed by each horizontal period and have opposite polarities in the each horizontal period.

6. The device of claim 5, wherein the controller supplies the first and second polarity control signals simultaneously and respectively to the first and second blocks of data driver units.

7. The device of claim 5, wherein the display panel is an LCD panel.

8. The device of claim 5, further comprising:

a gate driver for sequentially driving the gate lines.

9. The device of claim 5, wherein the controller includes an inverter for generating the first and second polarity control signals of opposite phases.

10. The device of claim 5, further comprising:

an inverter for generating the first and second polarity control signals of opposite phases and supplying these signals to the controller.

11. The device of claim 5, wherein the timing controller supplies the first and second polarity control signals simultaneously and respectively to the first and second blocks of data driver ICs.

12. A method for operating a display panel having a plurality of data lines and gate lines, the method comprising:

dividing a plurality of data driver units of a data driver into a first block of data driver units and a second block of data driver units by a center line of all the plurality of data lines, the data driver supplying data to the data lines, wherein each of the first and second blocks has at least two data driver units; and supplying first and second polarity control signals respectively to the first and second blocks of data driver units, the first and second polarity control signals having opposite phases to each other, wherein the first and second blocks of data driver units are driven according to a dot inversion method, wherein each data driver IC includes a shift register array supplying sequential sampling signals, a latch array sequentially latching and simultaneously outputting pixel data in response to the sampling signals, a DAC array converting the pixel data into a positive (+) polarity pixel voltage signal and a negative (−) polarity pixel voltage signal according to the first or second polarity control signal, and an output buffer array buffering and outputting the pixel voltage signals to the data lines, and wherein a polarity of the first polarity control signal and a polarity of the second polarity control signal are changed by each horizontal period and have opposite polarities in the each horizontal period.

13. The method of claim 12, wherein the supplying step supplies the first and second polarity control signals simultaneously and respectively to the first and second blocks of data driver units.

14. The method of claim 12, wherein the display panel is an LCD panel.

15. The method of claim 12, further comprising:

sequentially driving the gate lines.

* * * * *